United States Patent [19]

Johnard

[11] 4,279,954

[45] Jul. 21, 1981

[54] WEB WITH RELIEF-STRUCTURED SURFACE AND METHOD OF MAKING THE SAME

[75] Inventor: Bengt O. Johnard, Hovaas, Sweden

[73] Assignee: Forbo Betriebs AG, Zürich, Switzerland

[21] Appl. No.: 101,059

[22] Filed: Dec. 6, 1979

[30] Foreign Application Priority Data

Dec. 7, 1978 [CH] Switzerland ..... 12492/78

[51] Int. Cl.[3] ..... B32B 3/12; B32B 3/30; B32B 3/26

[52] U.S. Cl. ..... 428/158; 156/79; 264/52; 428/159; 428/160; 428/203; 428/204; 428/205

[58] Field of Search ..... 428/158, 159, 160, 310, 428/315, 201, 203, 204, 205; 264/52; 156/79

[56] References Cited

U.S. PATENT DOCUMENTS

| | | | |
|---|---|---|---|
| 2,961,332 | 11/1960 | Nairn | 156/79 |
| 3,293,094 | 12/1966 | Nairn et al. | 264/52 |
| 3,293,104 | 12/1966 | Hull | 428/155 |
| 3,293,108 | 12/1966 | Nairn et al. | 428/159 |
| 3,616,171 | 10/1971 | Hoskinson, Sr. | 428/310 |
| 4,002,520 | 1/1977 | Fenton | 264/46.4 |
| 4,012,248 | 3/1977 | Rump et al. | 264/52 |

FOREIGN PATENT DOCUMENTS

| | | | |
|---|---|---|---|
| 1270669 | 7/1961 | France | 428/159 |
| 570866 | 12/1975 | Switzerland | 428/159 |

*Primary Examiner*—William J. Van Balen
*Attorney, Agent, or Firm*—Michael J. Striker

[57] ABSTRACT

A relief-surface web and a method of making the same are disclosed. The web has a relief-structured surface, a printed pattern in registry with the relief and at least one coextensive layer which consists at least in part of foamed macromolecular material. The relief structure is obtained by varying thickness of the layer of macromolecular material and the cells of the foamed material are the larger the greater the thickness of the layer. The surface of the foamed layer which has the relief structure is provided with a fibrous web which is united with the foamed layer. The fibrous web accommodates itself to the relief structure formed by the different thickness of the foamed layer and the material of the fibrous web is plastically deformable at the foaming temperature required for foaming the macromolecular material. The web is useful for a variety of purposes, including as a decorative covering for walls and floors.

2 Claims, 3 Drawing Figures

WEB WITH RELIEF-STRUCTURED SURFACE AND METHOD OF MAKING THE SAME

BACKGROUND OF THE INVENTION

The present invention relates to web in general, and more particularly to webs having a relief-structured surface and a pattern which is in register with the relief structure.

The invention also relates to a method of making such a web.

It is known to make multilayer polymer webs with relief-structured surfaces and patterns which are in registry with the structure, in a variety of ways. For example, foamed or unfoamed polymer panels can be printed with a desired pattern and thereupon be embossed. However, it is then difficult to obtain a registry of the printed pattern and the embossed pattern. A relatively large percentage of the production must be discarded as scrap. Moreover, the embossing effects on a finished polymer foil or on a foam layer are not permanent because the natural elasticity of the polymer materials results in a return to the original state, i.e. in an elimination of the embossment over a period of time.

Another proposal has been made in U.S. Pat. No. 2,964,799 according to which only those portions of a polymer web which are to be foamed, are embossed with a heating roller which heats them and causes them to foam. This is an improvement on the previous proposals, but it is still difficult to obtain a precise registry of the printed pattern and the embossed pattern. Methods of making chemical embossments have been proposed in Swiss Pat. No. 570,866, in French Pat. No. 1,270,669 and in the U.S. Pat. Nos. 3,293,094 and 3,293,108. In all of these cases a pre-gelled plastisol has printed on it, together with the desired pattern, one or more substances which influence the decomposition temperature of the blowing agent and which does regulate the foam formation. These substances may also cause the cross-linking of certain areas which are not to undergo foaming. The printing may be effected in accordance with known methods, preferably by intaglio printing. These proposals obtain a good registry between the printed pattern and the relief pattern. However, printing of pre-gelled plastisols is somewhat difficult because it is necessary to use solvent-containing inks which in turn requires the application of protective measures, such as the use of recovery installations and similar devices for toxicological and safety reasons. Then again, the selection of the type of solvent used is strictly limited because solvents which dissolve or cause substantial swelling of the plastisol surface would result in a destruction of the printed pattern. Another problem is that the colored print which can be obtained is also subject to limitations, because the degree of color saturation is limited when smooth non-absorbent surfaces—as in the case of pre-gelled plastisols—are being printed. In the one-color area of a printed pattern the surfaces show often an undesirable characteristic appearance, namely a mottled effect which results from the splitting of the ink layer between the plastisol surface and the surface of the printing roller, which splitting occurs as the printing roller and plastisol surface move apart. Still another problem is that these proposals are primarily limited to the use of the expensive intaglio printing process.

SUMMARY OF THE INVENTION

Accordingly, it is an object of the present invention to avoid the drawbacks of the prior art.

A more particular object of the invention is to provide an improved web of the type in question, which has improved characteristics and can be manufactured in a simpler manner than heretofore.

A concomitant object is to provide an improved method of making such a web.

Pursuant to these objects and to others which will become apparent hereafter, one feature of the invention resides in a web, comprising a base layer of at least partially foamed macromolecular material and having a varying thickness so as to provide a relief-structured surface, a top layer over the surface and having a contour following the relief-structure of the surface, and an intermediate fibrous web between the layers in conformance with the relief structure and being composed of a fibrous material which softens at the foam-forming temperature of the macromolecular material.

A method of making a web of the type outlined above, may comprise the steps of sandwiching a fibrous web which is deformable at a predetermined temperature between a top layer and a base layer of macromolecular material which foams when subjected to the aforementioned temperature. The base layer is then caused to undergo foaming to different extents at different locations of the base layer by exposure to the predetermined temperature, under the influence of foam controlling agents in some of the locations whereby the base layer develops a relief structure at an interface with the fibrous web and the relief structure is imparted to the fibrous web due to its deformation ability at that temperature and is concomitantly imparted to the top layer.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
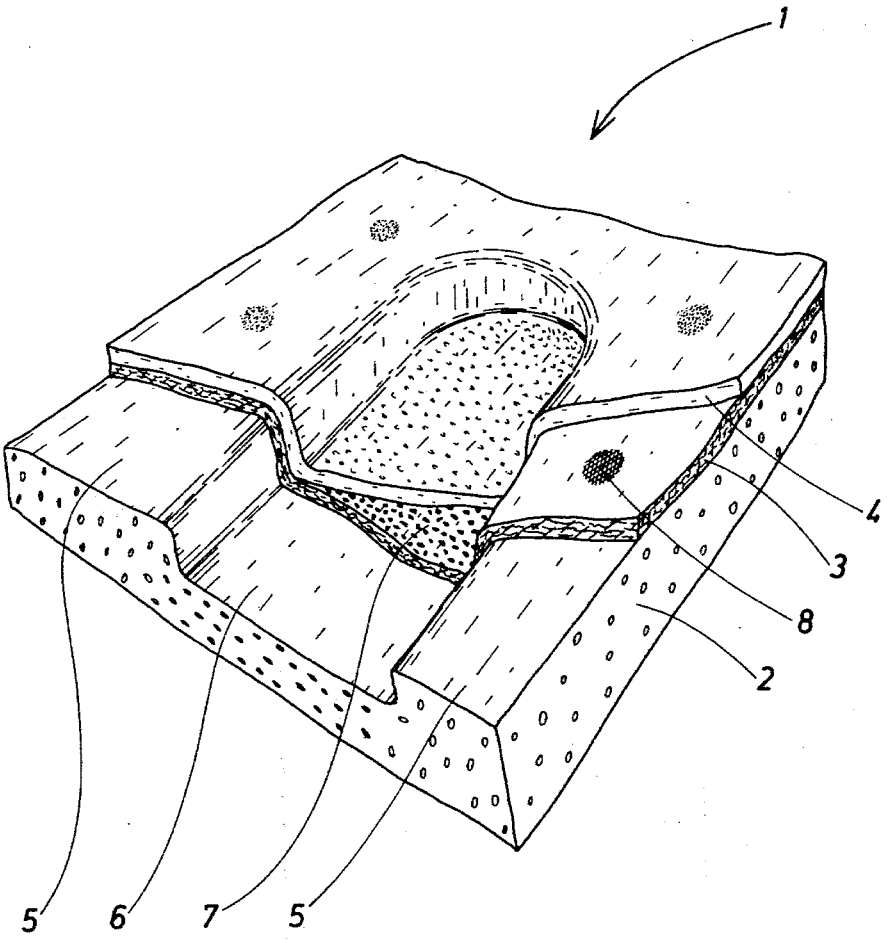
FIG. 1 is a partly sectioned, partly broken-away perspective view illustrating a web according to the present invention.

Referring firstly to FIG. 1 which shows a web according to the present invention, it will be seen that reference numeral 1 identifies a portion of such a web which is not shown in its entirety. The web has a base layer 2 of foamed macromolecular material which is foamed to different degrees. As the drawing shows, the area 5 is strongly foamed so that there are large cells formed in it, whereas a small-celled area 6 is also present. Because of the different degrees of foaming the layer 2 has a surface (here shown as the upper surface) which is formed with a relief structure as illustrated, resembling an embossing effect. Of course, the illustrated layer 2 which has only two thicknesses is representative of nearly the simplest form of execution; evidently, in actual use there will normally be many thickness variations in the layer 2. Portions of the panel 2 may also be completely unfoamed, although this is not shown in the drawing.

A web 3 of fibrous material overlies the surface of the layer 2 to which it is bonded and it follows the contour (i.e. the relief structure) of the surface of the layer 2. Located on top of the web 3 is a printed pattern 7 which is in registry with the relief structure of the layer 2 and web 3, i.e. the printing 7 is only (in this particular embodiment) in the area of the depressed portion of the surface of the layer 2. The remainder of the printed pattern 7 is identified with reference numeral 8 and is distributed over those portions of the surface of layer 2 which are not depressed in the exemplary embodiment; in this particular embodiment the purpose of the portions 8 is to impart a suggestion of shading to the basic colors of the pattern. To protect the printed pattern an additional layer 4 may be placed over the print 7, the layer 4 being of transparent non-foamed polymer material which is bonded to the print 7 and which also follows the relief structure of the layer 2. Since the layer 4 is transparent it permits both structure and the printing to be viewed. The layer 4 may, however, be omitted or, if present, it need not always be uniformly transparent nor does it need to be colorless.

The macromolecular material for the base layer 2 may be polyvinyl chloride which can be used in dispersed form, preferably as a plastisol or as a paste. However, other thermoplastic macromolecular materials may also be used, such as polyvinyl chloride/vinylacetate-copolymer, acrylate or methacrylate. These polymers may include the usual known-per se additives, such as softeners, fillers, pigments and/or stabilizers, for example ultraviolet absorbents antioxidants and thermo stabilizers. The fibrous web 3 may be a fabric or, preferably, a fibrous nonwoven. It must be of a material which undergoes softening (i.e. plastic deformation) at the temperature at which the layer 2 undergoes foaming, so that it is enabled to accommodate itself to changes in the surface of the layer 2, i.e. changes which occur at the interface of the layer 2 with the web 3. The plastic deformability of the fibrous web 3 at the foaming temperature of the base layer 2 is one of the essential characteristics of the invention. It is important that the web 3 does not resist the foaming of the macromolecular material of the base layer 2, since this would prevent or at least significantly limit the development of the desired relief structure at the interface between the layer 2 and the web 3. It has been found that the web 3 may be of polyester, polyamide, polyolefin and/or polyacrylate, and any of these may be mixed with regenerated cellulose or with natural fibers. If a nonwoven is used, the fibers may be of a type which does not undergo plastic deformation at the foaming temperature of the layer 2, but in such a case the binder used to bind the fibers 3 must itself be enough plastically deformable at the aforementioned temperature. Depending upon the effect to be obtained the fibrous web 3 may be provided with the print 7 in a one-color or multi-color printed pattern. Additional optical effects may be obtained by finer or coarser denier of the web 3 or by a particular arrangement or treatment of the fibers of the web 3. For example, the web 3 may be mechanically embossed or roughened to obtain a particular appearance.

The layer 4 which is advantageous because of the protection it affords for the web 3 and the printed layer 7 thereon, but which is nevertheless optional, may be of polyvinyl chloride, polyurethane or an acrylate polymer and may contain the conventional known-per se additives, such as softeners and stabilizers, for example ultraviolet absorbent, antioxidants and thermo stabilizers.

The side of the web which is directed away from the viewer may be provided with a reinforcing layer. However, in contrast to the known web of this general type this is not obligatory in the web according to the present invention because the web is already reinforced mechanically by the presence of the fibrous web 3. If a reinforcing layer is used, however, then this may be in form of a substrate layer of requisite strength and flexibility, for example coated or uncoated glass fiber non wovens, polyester nonwoven, asbestos paper, substrates on cellulose basis or those made from a mixture of cellulose and mineral wool, fiber nets and fibrous non wovens with such fiber nets. Coated glass fiber non wovens has been found to have a superior adhesion to the layer 2 of macromolecular material.

The web according to the present invention may also have two or more layers, corresponding to the layer 2, and being of the same or of different molecular materials, with at least one such layer being coextensive with the overall web and being foamable.

Pursuant to the method forming a part of the invention a fibrous web 3 of the type described above may be printed with a one-color or multi-color print 7 forming a pattern, as well as with a substance regulating the foaming of the layer 2. This printing may be effected with known inks in one or several steps and with any suitable method known to be applicable to the particular type of fibers chosen in the fibrous web 3. Printing inks which are water soluble or which require a solvent may be used. In contradistinction to the methods known from the prior art it is also possible to use solvents which dissolve or swell polyvinyl chloride. The printing methods which can be used include intaglio printing, relief printing or offset printing, and particularly screen printing.

It is a particular advantage of the invention that the use of a fibrous web, i.e. of a material which is capable of ink absorption, permits the application of printing methods which are to be generically identified herein as Ink Jet Printing (IJP). In this type of printing the printed pattern is produced by controlled spraying of ink onto the particular surface through nozzles. Since the nozzles being used can rather readily be clogged by dried ink, it is necessary to use low-viscosity inks with a high proportion of solvent or of dispersion medium. Accordingly, only absorbent substrates can be printed according to the Ink Jet Printing method if the production speed is not to be strongly limited by the characteristics of the solvents. Ink Jet Printing has heretofore been impossible to use with the pre-gelled plastisols onto which printing was effected, and the present invention—using for the first time an absorbent substrate for this purpose—is the proposal which permits the use of Ink Jet Printing for the production of polymer webs with relief-structured surfaces. The use of Ink Jet Printing, however, is particular advantageous because it permits a rapid and inexpensive change-over from pattern to pattern, it being understood that the selection of the pattern is electronically controlled and that switching from one pattern to another is therefore simple. A further advantage of the use of an absorbent substrate, i.e. the fibrous web 3, is the fact that several printing steps can be carried out in succession without having to wait for a drying period to elapse, because the solvent is absorbed by the web 3 and thus eliminates the need for waiting.

The substance which regulates the foaming of the material of the layer 2 may preferably be applied as a component of the printing ink itself, or it may be applied in a separate operation. In the latter case, the foam-regulating substance can be applied either to the surface of the web 3 which faces towards the layer 2, or else the surface which faces away from the layer 2. There is no problem in applying the substance in such a manner that it will be in registry with the printed pattern of the layer 7. If the foam-regulating substance is applied to the surface of the web 3 which faces away from the polymer layer 2, then of course it is necessary that it be capable of penetrating through the web 3 in order to reach the layer 2. The absorption capability and thus the penetrability of the web 3 to the foam-regulating substance can be improved by treating the web 3 with appropriate ten sides which are known per se in the art. Such a treatment also increases the ability of the web 3 to absorb the ink for the printed pattern, which in turn permits printing with strong, vibrant colors. It goes without saying that other colors, such as plastisol inks, can also be used.

The foam-regulating substances which can be used according to the present invention may be inhibiting substances as well as stimulating substances. These are known per se in the art, and by way of example trimellitic acid-anhydride is mentioned as an inhibitor as well as oxalic acid and thiourea.

The web 3 provided with the layer forming the printed pattern 7 and with the foam-regulating substance is usually light-weight and thin. It can be readily stored, even for prolonged periods of time, and can be equally readily shipped so that the invention offers flexibility in logistical terms as well as in method terms.

The material for the layer 2 is, as mentioned before, a foamable macromolecular material. Particularly advantageous is the use of a polyvinyl chloride plastisol incorporating a blowing agent. Blowing agents suitable for this purpose are known per se to those skilled in the art. They include, for example, azodicarbonamides, such compounds as disulfohydrazide, morpholylthiatriazole and azobutyrateisodinitrile. The macromolecular material may of course also include further additives known to those skilled in the art and influencing its working and/or the charateristics of the finished product.

The material of the layer 2 may be applied to the web 3 either in liquid or in pasty form, or as a pre-gelled layer. When this contact occurs, the surface provided with the foam-regulating substance (or to which the foam-regulating substance has penetrated) comes in contact with the material of the layer 2. The application of the macromolecular material in liquid or pasty form to the web 3 or to an auxiliary carrier for the pre-gelling operation can be effected according to the methods which are known per se for this purpose, for example by use of a doctor blade, by pouring, by spraying or in other suitable manner. The combination of the fibrous web 3 and the as yet unfoamed macromolecular material of the layer 2 is then advanced into a heater or furnace of known construction, where it is subjected to sufficiently high temperature to cause foaming of the macromolecular material. Due to the effect of the foam-regulating substance different cellular sizes and accordingly different thicknesses of the layer 2 are obtained during such foaming, so that a relief-structured surface (as shown in FIG. 1) is obtained for the layer 2 and consequently for the web 3 which follows this surface. The fact that the layer 3 accommodates itself to the structuring of its interface with the layer 2 without requiring any additional steps and merely due to the fact that it softens at the foaming temperature of the layer 2, is quite surprising, even more so when taking into account the low pressures exerted during the foam development. The web 3 remains bonded to the layer 2 in conformance with the surface structure thereof, without any stresses even after the compound material has cooled down.

The finished web can now be used in this form or during or subsequent to its manufacture it can be provided with the layer 4 mentioned above and/or the reinforcing layer which has also been mentioned. If the layer 4 is applied to the finished web, then a method must be selected which does not cause damage to the surface structure of the web, for example a rotary printing method.

The invention permits the manufacture of panels with any desired decorative patterns, particularly with those corresponding to the structure and color effects of high-quality decorative ceramic plates. The homogeneity of the individual color zones and the color strength and depth is significantly increased over what is known from the prior art, due to the inventive use of the fibrous web 3. The selection of the components for the printing inks is practically unlimited from the technical point of view. For example, the previously unacceptable aqueous substances, or those containing solvents dissolving polyvinyl chloride or causing polyvinyl chloride to undergo strong swelling, can now be readily used without any difficulties. The free selection of the printing inks of course also makes it possible to use a greater variety of printing methods than heretofore possible, which is advantageous from an economic point of view as well as permitting the production of more differentiated decorative effects.

Fibrous web provided with the printed pattern and with the foam-regulating substance can be readily stored prior to use, so that the technologically more difficult and expensive part of the method according to the present invention, namely the printing, can be effected at a central location and the completion can be carried out elsewhere and at a later time.

Since the fibrous web 3 acts both as the substrate on which printing is effected and also as a reinforcement in a mechanical sense, the use of the previously obligatory reinforcing layer is no longer necessary so that the economy of manufacture of the web according to the present invention is correspondingly increased.

The web according to the present invention has manifold uses. For example, it may be used as a decorative floor covering or wall covering, but of course it can be used for decoration and/or protection of other surfaces as well. A further advantage of the invention results in connection with this, namely the use of the fibrous web 3 eliminates the formation of air inclusions as is always observed in other multi-layer products of this type. Since air inclusions tend to result in de-lamination (i.e. separation of the layers) when the web is subjected to mechanical stresses, their elimination is of particular importance, especially if the material is to be used as a floor covering. The web according to the present invention is thus much more resistant to mechanical stressing than those of the prior art, and is of particular advantage as a floor covering for use in areas where conveyances such as wheel chairs are used.

Figure 2:
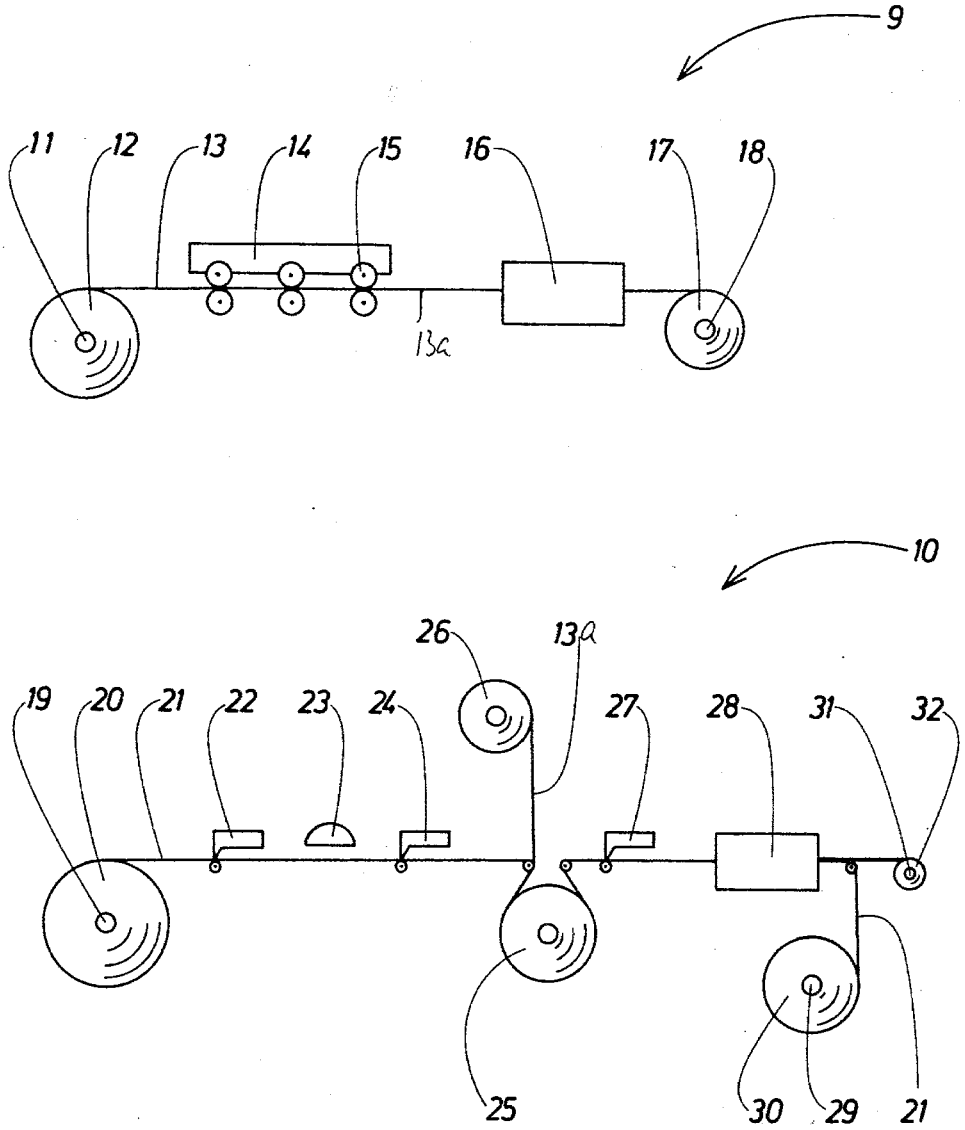
FIG. 2 is a diagrammatic side view illustrating an arrangement for carrying out the method of making a web according to the invention.

Coming now to FIG. 2 it will be seen that the installation 9 shown therein for carrying out the method according to the present invention serves for printing of the fibrous web 13, and the installation 10 serves for uniting the fibrous printed web 13*a* obtained from the installation 9 with the macromolecular material.

The fibrous web 13 which is heretofore unprinted is withdrawn in installation 9 from the supply roller 12 which turns about the axis 11, and is advanced to the printing unit 14 which is provided with printing rollers 15 so that it can print on both sides of the web 13. In the printing unit 14 the printed pattern as well as the foam-regulating substance are applied to the web 13. The printed web, now designated with reference numeral 13*a*, is advanced to the furnace 16 in which it is dried and is then taken up on the roll 17 which turns about the axis 18. This roll can then be stored, later on shipped elsewhere, or immediately used for the production of the finished web.

In any case, the production at whatever time is carried out in the installation 10 where release paper 21 is withdrawn from the supply roll 20 rotatable about the axis 19 and is advanced to a first coating station 22 where a first quantity of synthetic plastic material is applied to it. This is then passed between a heat radiating station 23 and supplied to a second coating station 24 where the foamable synthetic plastic material containing an appropriate blowing agent is applied to it. The printed fibrous web 13*a* is withdrawn from the supply roll 26 which corresponds to the roll 17 of the preceding step and is guided, together with the coated release paper 21, over the heated drum 25 so that the synthetic plastic material on the released paper 21 becomes united with the web 13*a*. The thus obtained multi-layer product is now (optionally) advanced to a further coating station 23 where a layer of synthetic plastic material corresponding to the transparent layer 4 of FIG. 1, is applied to it. Finally, the thus obtained web is advanced to the oven or furnace 28 in which gelling, respectively foaming of the foamable layers is effected. The release paper 21 is then stripped from the product which is finished as it leaves the furnace 28 and is taken up on a roll 30 which turns about its axis 31. The finished panel, composed of the transparent layer, the fibrous web, the foamed polymer layer and unfoamed polymer layer is then taken up on a roller 32 which turns about the axis 31.

As discussed with reference to FIG. 2, the material forming the layer 4 of FIG. 1 is applied immediately prior to the gelling and foaming operation. This layer can, however, also be applied directly upon the printed fibrous web 13*a* prior to the application of the web 13*a* to the as yet unfoamed polymer material, or it can be completely omitted. The installations 9, 10 may evidently be arranged one behind the other, and depending upon the operating speed the rollers 16 and 27 may be omitted.

Figure 3:
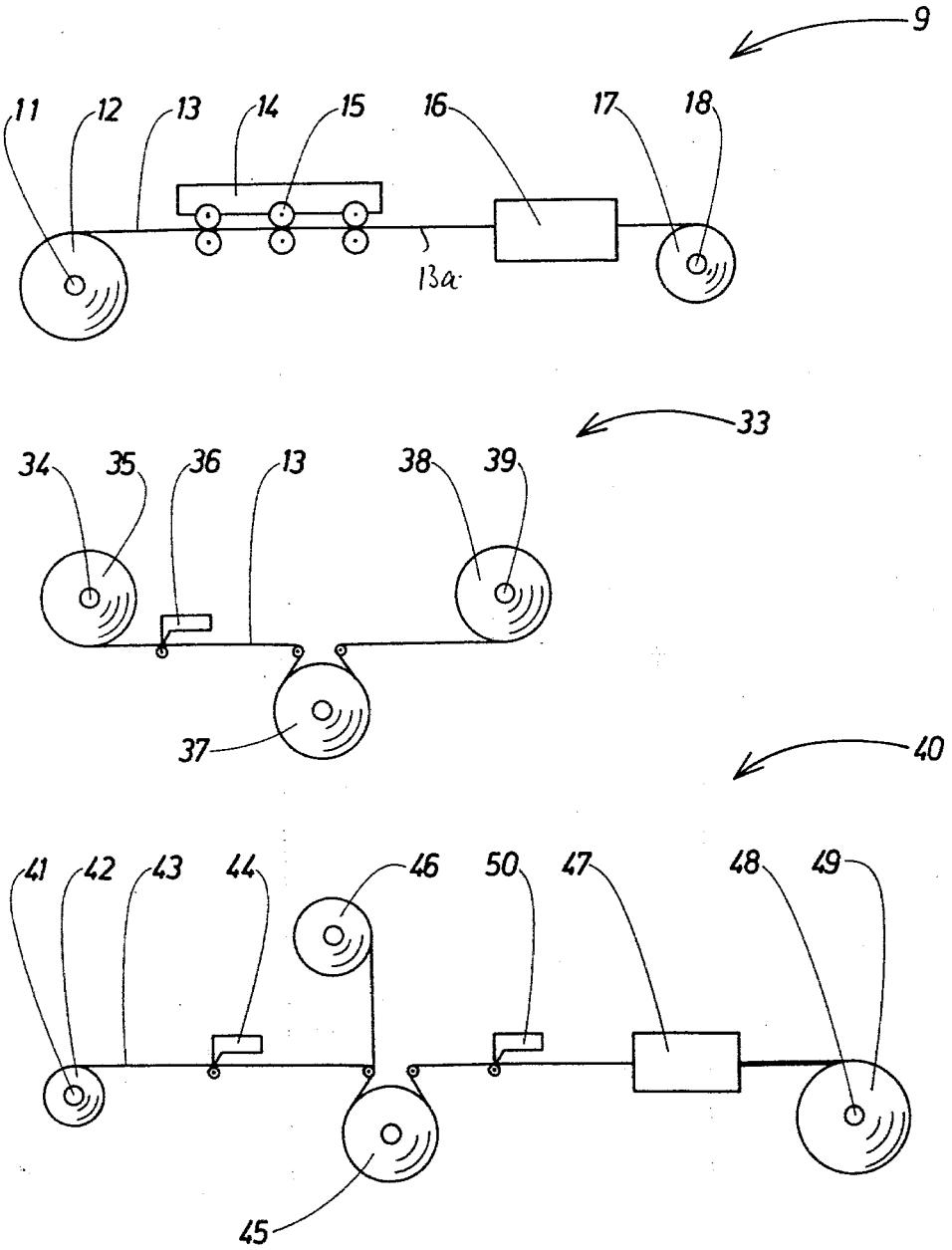
FIG. 3 is a view analogous to that in FIG. 2, but illustrating a somewhat different arrangement.

A further embodiment of the invention is shown in FIG. 3, illustrating three installations 9, 33 and 40. Inasmuch as the installation corresponds to the one described above with respect to FIG. 2, a further discussion of the installation 9 in FIG. 3 is not deemed necessary.

In the installation 33 of FIG. 3 the printed fibrous web 13*a* is withdrawn from the supply roller 35 which turns about the axis 44 and is advanced to a doctoring station 36 where a synthetic plastic material which is to form later the transparent layer 4, is wiped onto it. The combined layers are then advanced to a heating drum 37 where they are pre-gelled and the composite is then taken up on the roll 38 which rotates about axis 39.

In the third installation 40 a reinforcing layer 43 is withdrawn from a supply roll 42 which turns about axis 41, is advanced in a doctoring station 44 where it is coated with a blowing agent-containing synthetic plastic material and thereafter united with the composite that has been produced in the installation 33. The combined layers are now passed over the heating drum 45 and united with one another. In the doctoring station 50 a further layer is applied, and the combined layers are then advanced to the furnace 47 where they are gelled, respectively foamed. The finished product, composed of the reinforcing material, a layer of foamed macromolecular material, the printed fibrous web and a transparent cover layer applied in two steps, is then taken up on roll 49 which rotates about axis 48.

In the installation 43, and more particularly in the doctoring station 36 thereof, the material for the transparent layer 4 can be omitted and in its place the material for the layer 2 can be applied in the station 36 to the surface of the fibrous web 13*a* which does not have the printing on it, to be united with the web on the heating drum 37 and to undergo pre-gelling thereat, whereupon the intermediate product is then further treated in the installation 40 as described above.

The individual elements used in the installations shown in FIGS. 2 and 3 are known per se to those skilled in the art and require no further discussion. They can be used in different combinations than those shown if desired or necessary.

The invention will now be further described with respect to some examples, for a better understanding.

EXAMPLE 1

In this example the installations 9 and 10 illustrated in FIG. 2 are used. The printing unit 14 is a screen printing machine and an aqueous printing ink is used which penetrates through the web 13. The foam-regulating substances then also penetrate and become available at the side of the web 13 which is not printed. The moist web 13*a* is dried in the furnace 16 and is then taken up on a roller. A release paper is coated with synthetic plastic material and the latter is subjected to pre-gelling at 130°-140° C. A foaming agent containing synthetic plastic material is applied to the pre-gelled layer and is united with the web 13*a* on the heating drum 25 at a temperature of 135°-145° C. The foaming agent-containing synthetic plastic material is foamed in the furnace 28 at 190° C. and at the same time the other synthetic plastic layers are also gelled. The respective thickness of the foamed layer, and thus the relief structure resembling the desired embossment, is dependent upon the type and concentration of the utilized foam-regulating substances. At the same time as the foaming proceeds, the fibrous material of the web 13*a* also becomes deformable and accommodates itself to the surface structure developing on the layer 2.

The following materials are used in this particular embodiment:

| | Variant A | | Variant B |
|---|---|---|---|
| Fibrous Sliver: | | | |
| Weight | 50g/m² | | 10 to 500 g/m² |
| Fiber | Polyester | | Polyamide, polyproprene |
| Binder | Polyvinylacetate | | Vinylcopolymers |
| Printing inks without foam-regulating substances: | | | |
| Base | Acrylic resin Pextol BV 410 | 20 weight % | Vinylcopolymers |
| Dispersion medium | Water | 75 weight % | Aqueous alcohols, glycols, ketones |
| Pigments | Mineral pigments | 5 weight % | Organic pigments |
| Printing inks with foam-regulating substances: | | | |
| Base | Acrylic resin Plextol BV 410 | 20 weight % | Vinylcopolymers |
| Dispersion medium | Water | 75 weight % | Aqueous alcohols, glycols, ketones |
| Pigments | Mineral pigments | 5 weight % | Organic pigments |
| Foam-regulating substances | Oxalic acid | 3 weight % | Thiourea |

In addition, a printing ink of the following composition and on solvent basis is used:

| | | |
|---|---|---|
| Base | PVCAc (15% acetate), K-value 50 Vinityte VYHH | 2 weight % |
| Solvent | Methylethylketone | 55 weight % |
| Pigments | Mineral- or organic pigments | 5 to 10 weight % |

If desired, between 2 and 10 weight % of trimellithic acid anhydride may be added to this printing ink as foam-regulating substance.

| | | |
|---|---|---|
| First plastic preparation: | | |
| Base | PVC Pevikon PE 702 | 100 weight % |
| Softener | Dioctylphthalate | 90 weight % |
| Stabilizer | Ba-Cd-stabilizer | 2 weight % |
| Fillers | Calcium carbonate | 150 weight % |
| Blowing agent-containing plastic preparation (foam layer 2 in FIG. 1): | | |
| Base | PVC Pevikon PE 710 | 100 weight % |
| Softener | Dioctylphthalate | 60 weight % |
| Stabilizer | Lead phosphite | 1.5 weight % |
| Blowing agent | Azodicarbonamide | 3 weight % |
| Transparent plastic preparation (cover layer 4 in FIG. 1): | | |
| Base | PVC, K-value 70 Vestolit B 7021 | 100 weight % |
| Softener | Dioctylphthalate | 60 weight % |
| Stabilizer | Ba-Cd-Stabilizer | 2 weight % |

The used PVC-types are:

| Name | K-value | Maker |
|---|---|---|
| Pevikon PE 702 | 70 | Kema-Nobel AG (Sweden) |
| Pevikon PE 710 | 70 | Kema-Nobel AB (Sweden) |
| Vestolit B 7021 | 70 | Chem. Werke Huls (FRG) |

EXAMPLE 2

This example is produced in the installations 9, 33 and 40 illustrated in FIG. 3. The unprinted surface of the web 13*a* has a 0.3 mm thick layer of a blowing agent-containing plastisol doctored onto it which is then pre-gelled on the heating drum 37 at 150° C.

Asbestos paper is coated in the installation 40 with a filler-containing plastisol. This plastisol layer is united with the pre-gelled plastisol layer on the web 13*a* at 140° C. on the heating drum 45, whereupon the top or protective layer 4 is applied to the free surface of the web 13*a*. The finished panel according to the present invention is then produced, as discussed with respect to Example 1, by heat treatment in the furnace 47.

The materials used in this example correspond to the variants A and B in Example 1.

While the invention has been illustrated and described as embodied in a structured-surface web, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A decorative web, comprising a base layer of at least partially foamed macromolecular material and having a varying thickness so as to be provided with a relief-structured surface; a top layer over said surface and having a contour following the relief-structure of said surface; an intermediate printed fibrous web between said layers in conformance with said relief-structure and being composed of a fibrous material subject to deformation at the foam-forming temperature of said macromolecular material; and a printed visually observable pattern and in registry therewith a pattern of foam regulating medium which latter, on deformation of the fibrous material at the foam-forming temperature, regulates the foaming of the macromolecular material so as to cause formation of said relief-structured surface thereon.

2. A method of making a decorative web, comprising the steps of printing a fibrous web which is subject to deformation at a predetermined temperature, with a visually observable pattern and in registry therewith with a pattern of foam regulating medium; sandwiching the printed fibrous web between a top layer and a base layer of macromolecular material which foams when subjected to said predetermined temperature; and causing said base layer to undergo foaming to different extents at different locations of the base layer by exposure to said predetermined temperature whereby, due to the foam controlling action of the foam regulating medium the base layer develops a relief structure at an interface with said fibrous web and said relief structure is imparted to said fibrous web due to deformation thereof and is concomitantly imparted to said top layer.

* * * * *